US008678959B2

(12) United States Patent
McGibbon

(10) Patent No.: US 8,678,959 B2
(45) Date of Patent: Mar. 25, 2014

(54) GOALIE HOCKEY STICK

(76) Inventor: David McGibbon, Beaconsfield (CA)

( * ) Notice: Subject to any disclaimer, the term of this patent is extended or adjusted under 35 U.S.C. 154(b) by 0 days.

(21) Appl. No.: 13/246,448

(22) Filed: Sep. 27, 2011

(65) Prior Publication Data

US 2012/0202625 A1 Aug. 9, 2012

Related U.S. Application Data

(60) Provisional application No. 61/386,697, filed on Sep. 27, 2010.

(51) Int. Cl.
*A63B 59/14* (2006.01)

(52) U.S. Cl.
USPC ..... 473/562; 473/563

(58) Field of Classification Search
USPC ..... 473/560–563
See application file for complete search history.

(56) References Cited

U.S. PATENT DOCUMENTS

| | | | | |
|---|---|---|---|---|
| 4,651,990 | A * | 3/1987 | Profit | 473/563 |
| 5,217,221 | A * | 6/1993 | Baum | 473/561 |
| 5,853,338 | A * | 12/1998 | Ubriaco | 473/562 |
| 5,863,268 | A * | 1/1999 | Birch | 473/563 |
| 7,282,001 | B2 * | 10/2007 | Ponzini | 473/560 |
| 2004/0235592 | A1 * | 11/2004 | McGrath et al. | 473/560 |
| 2006/0281591 | A1 * | 12/2006 | Wikstrom et al. | 473/560 |
| 2010/0125010 | A1 * | 5/2010 | Martin | 473/446 |

* cited by examiner

*Primary Examiner* — Mark Graham
(74) *Attorney, Agent, or Firm* — Thomas & Karceski, PC

(57) ABSTRACT

A goalie hockey stick having a handle with a handle top end and a handle bottom end, the handle bottom end having a first female receiver therein, a paddle with a paddle top end and a paddle bottom end, the paddle top end having a first male end disposed thereon, the bottom end having a second female receiver therein, the first male end being inserted into the first female receiver, and a blade with a blade top end and a blade bottom end, the blade top end having a second male end disposed thereon, the second male end being inserted into the second female receiver. The handle, the paddle, and the blade are removably connected to one another.

20 Claims, 10 Drawing Sheets

GOALIE HOCKEY STICK

CROSS-REFERENCE TO RELATED APPLICATION(S)

This is a United States Non-Provisional Patent Application that relies for priority on U.S. Provisional Patent Application Ser. No. 61/386,697, filed on Sep. 27, 2010, the contents of which are incorporated herein by reference.

FIELD OF THE INVENTION

The present invention concerns hockey equipment, particularly hockey sticks. More specifically, the present invention concerns a hockey stick used by a goalie.

DESCRIPTION OF THE RELATED ART

As should be apparent to those skilled in the art, there are a variety of hockey sticks that are available in the market for use.

Traditionally, hockey sticks have been manufactured, sold, and purchased as single units. This means that manufacturers traditionally offer a variety of hockey sticks for different positions on a hockey team. In addition, for each variety of hockey stick that is designed for positions on the team, manufacturers traditionally offer variations to accommodate different players. For example, it is known for manufacturers to provide hockey sticks of varying lengths for players of different heights.

In addition, not all hockey sticks share the same construction. There are variations among genres of hockey sticks to provide attractive features to players. For example, there are different hockey sticks for right-handed players and for left-handed players. In addition, the blades at the end of the hockey sticks (i.e., the portion that comes into contact with the hockey puck) may be provided with different shapes and curvatures to alter the manner in which the hockey stick performs.

While manufacturers traditionally have offered a variety of hockey sticks that have been adapted for use at specific player positions, hockey sticks traditionally are assembled and sold as a single unit, without interchangeable parts.

In this traditional environment, if a player desires to alter the performance of his or her hockey stick, the player is required to purchase a new hockey stick with desirable features. Manufacturers do not offer modular hockey sticks that permit modification of any portion of the hockey stick.

Goalie hockey sticks offer additional challenges. A typical goalie hockey stick includes three primary components, a handle, a paddle and a blade. The paddle, at the intersection between the paddle and the handle, defines a shoulder. Each of the handle, the shoulder, the paddle, and the blade are aspects of the goalie hockey stick that affects the performance of the goalie hockey stick. As such, these four features of a goalie hockey stick may be changed to alter the manner in which the goalie hockey stick performs.

In view of the foregoing, therefore, it should be apparent to those skilled in the art that manufacturers of hockey sticks are required to manufacture and maintain inventories of a large variety of hockey sticks to meet consumer demand. In addition, retailers of hockey equipment are required to maintain stocks including a wide variety of different hockey sticks. In addition, consumers are limited by the choices available in the marketplace.

As a result, there is an increasing preference to address one or more of the difficulties in the prior art.

SUMMARY OF THE INVENTION

It is one aspect of the present invention to address one or more of the deficiencies noted above with respect to the prior art.

Specifically, it is an aspect of the present invention to provide a goalie hockey stick with a modular construction with interchangeable and replaceable parts.

One embodiment of the present invention provides for a goalie hockey stick that includes a handle with a handle top end and a handle bottom end, the handle bottom end having a first female receiver therein, a paddle with a paddle top end and a paddle bottom end, the paddle top end having a first male end disposed thereon, the bottom end having a second female receiver therein, the first male end being inserted into the first female receiver, and a blade with a blade top end and a blade bottom end, the blade top end having a second male end disposed thereon, the second male end being inserted into the second female receiver. The handle, the paddle, and the blade are removably connected to one another.

In one contemplated embodiment, the handle, the paddle, and the blade are removably connected to one another via a press-fit connection between the first male end and the first female receiver and between the second male end and the second female receiver.

In another contemplated embodiment, the goalie hockey further includes a first fastener, provided with respect to the first male end and the first female receiver, to provide additional force to connect the handle and the paddle to one another, and a second fastener, provided with respect to the second male end and second first female receiver, to provide additional force to connect the paddle and the blade to one another.

Where a fastener is employed, it is contemplated that at least one of the first and second fasteners is a threaded fastener.

In still a further embodiment of the invention, at least one of the first and second fasteners is an adhesive, which may be a hot melt adhesive.

It is contemplated for another embodiment of the present invention that at least one of the first and second fasteners is a tape, which may be an athletic tape that includes cotton.

For an additional embodiment of the goalie hockey stick of the present invention, the paddle, and the blade are made from a carbon fiber composite material.

Wherein a carbon fiber composite material is used, the material includes at least one of woven or non-woven carbon fibers.

For yet another contemplated embodiment of the present invention, the paddle further includes at least three internal compartments extending longitudinally therein, and at least two bridges, connecting front and rear surfaces of the paddle to one another, the bridges separating the internal compartments from one another.

Where the goalie hockey stick includes internal compartments, a foam may be disposed within at least one of the at least three compartments within the paddle.

With respect to the foam, the foam is at least one of an open cell or closed cell foam.

In one contemplated embodiment of the goalie hockey stick of the present invention, the blade has at least three internal compartments extending longitudinally therein, and at least two bridges, connecting front and rear surfaces of the paddle to one another, the bridges separating the internal compartments from one another.

For the blade, a foam may be disposed within at least one of the at least three compartments within the blade.

The foam may be an open cell or closed cell foam and may occupy only a portion of the compartments.

With respect to the compartments within the blade, it is contemplated that there may be six internal compartments and the foam may be disposed within at least two of the compartments.

In a further embodiment of the goalie hockey stick of the present invention, a wear-resistant portion may be disposed along at least a portion of a bottom edge thereof. The wear-resistant portion may be formed as a braid of carbon fibers.

In addition, it is contemplated that the first and second female receivers will have depths greater than corresponding lengths of the first and second male ends.

Still further aspects of the present invention will be made apparent from the discussion provided below.

BRIEF DESCRIPTION OF THE DRAWINGS

The present invention will now be described in connection with the drawings appended hereto, in which.

DETAILED DESCRIPTION OF EMBODIMENT(S) OF THE INVENTION

The present invention will now be described in connection with one or more contemplated embodiments. The embodiments that are described are intended to be exemplary of the present invention and not limiting of the scope thereof. In other words, while attention is focused on specific embodiments of the present invention, those embodiments are not intended to limit the present invention. To the contrary, the examples provided below are intended to illustrate the broad scope of the present invention.

As indicated in the various figures, the present invention focuses on the construction of a goalie hockey stick 10. While the present invention is described in connection with a goalie hockey stick 10, the present invention should not be understood to be limited solely to goalie hockey sticks 10. To the contrary, the present invention may be employed for any type of hockey stick.

Figure 1:
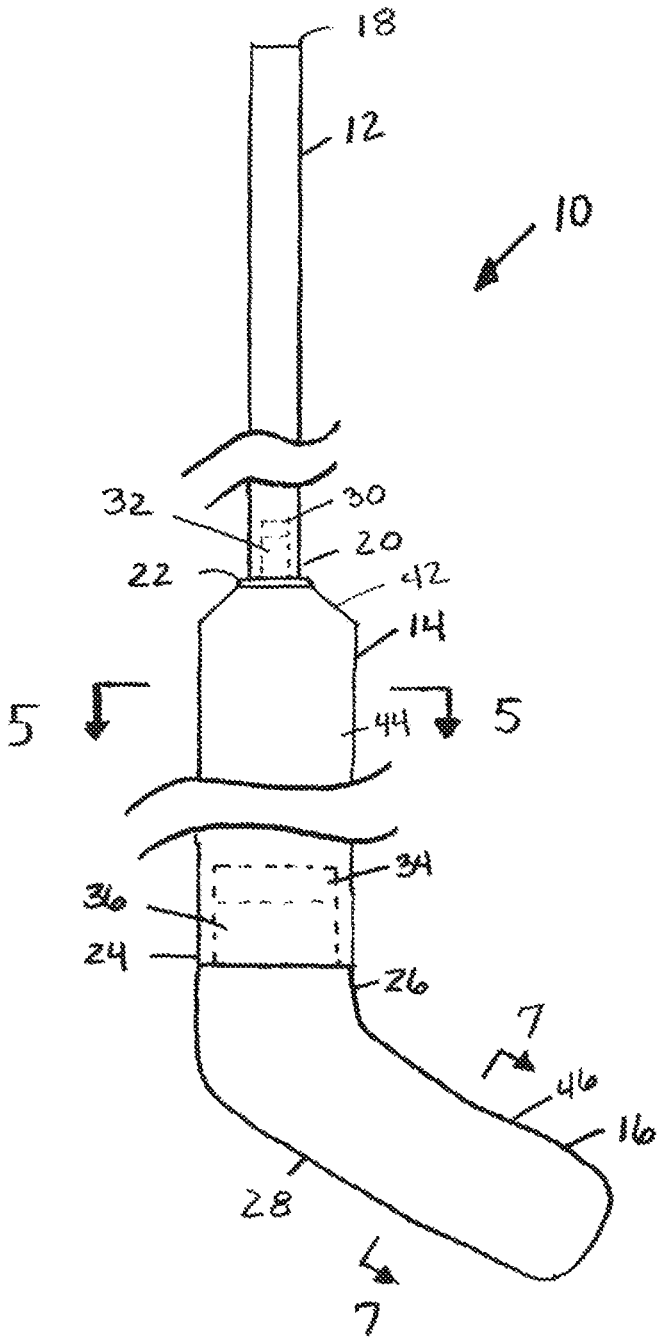
FIG. 1 is a front view of a goalie hockey stick according to the present invention.

FIG. 1 is a front view of a goalie hockey stick 10 according to the present invention. The goalie stick 10 includes a handle 12, a paddle 14, and a blade 16.

The portion 12, the paddle 14, and the blade 16 made be made from any suitable material. In the embodiment shown, the handle 12, the paddle 14, and the blade are made of a carbon fiber composite, which incorporates woven or non-woven fibers that are embedded in a resin material. While the present invention is described in connection with carbon fiber composites, any other suitable materials may be employed without departing from the scope of the present invention.

Examples of alternative materials include, but are not limited to metals, such as aluminum and aluminum alloys, magnesium and magnesium alloys, beryllium and beryllium alloys, titanium and titanium alloys, iron and iron alloys, plastics, thermoplastic materials, polymeric materials, rubber, rubber compounds, wood, fiberglass, aramid fibers, aramid fiber composites, nylon, and other man-made and natural materials.

In addition, it is not required that the handle 12, the paddle 14, and the blade 16 be made from the same materials. To the contrary, each of the handle 12, the paddle 14, and the blade 16 may be made from different materials. For example, the handle 12 may be made from aluminum, the paddle 14 may be wood, and the blade may be a carbon fiber composite material. Since there are virtually limitless combinations of materials that are possible, the combinations are not listed herein. However, any combination of suitable materials may be employed without departing from the scope of the present invention.

It is contemplated that the materials selected for each of the handle 12, the paddle 14, and the blade 16 will be light in weight but will also provide suitable strength and durability for the goalie hockey stick 10, as should be apparent to those skilled in the art.

As illustrated in FIG. 1, the handle includes a top end 18 and a bottom end 20. Similarly, the paddle has a top end 22 and a bottom end 24. The blade 16 also has a top end 26 and a bottom end 28.

The bottom end 20 of the handle 12 includes a female receiver 30. The female receiver 30 is provided to receive a male end 32 (also referred to as a tenon) that is provided at the top end 22 of the paddle 14. Similarly, a female receiver 34 is provided in the bottom end 24 of the paddle. The female receiver 34 receives a male end 36 (also referred to as a tenon), which is provided at the top end 26 of the blade 16.

The male end 32 of the paddle 14 is designed to fit with the female receiver 30 in the handle 12 with a press-fit construction. Similarly, the male end 36 on the blade 16 is constructed to be press-fitted into the female receiver 34 in the paddle 12. Specifically, the male ends 32, 36 and the female receivers 30, 34 are contemplated to be sized such that they establish sufficient forces between them, once assembled, to discourage disassembly without appreciable effort.

The goalie hockey stick 10 of the present invention is not intended to be limited solely to a construction where the male ends 32, 36 are press-fitted into the female receivers 30, 34. To the contrary, it is contemplated that the handle 12, the paddle 14, and the blade 16 may be connected to one another in any number of suitable fashions.

Figure 3:
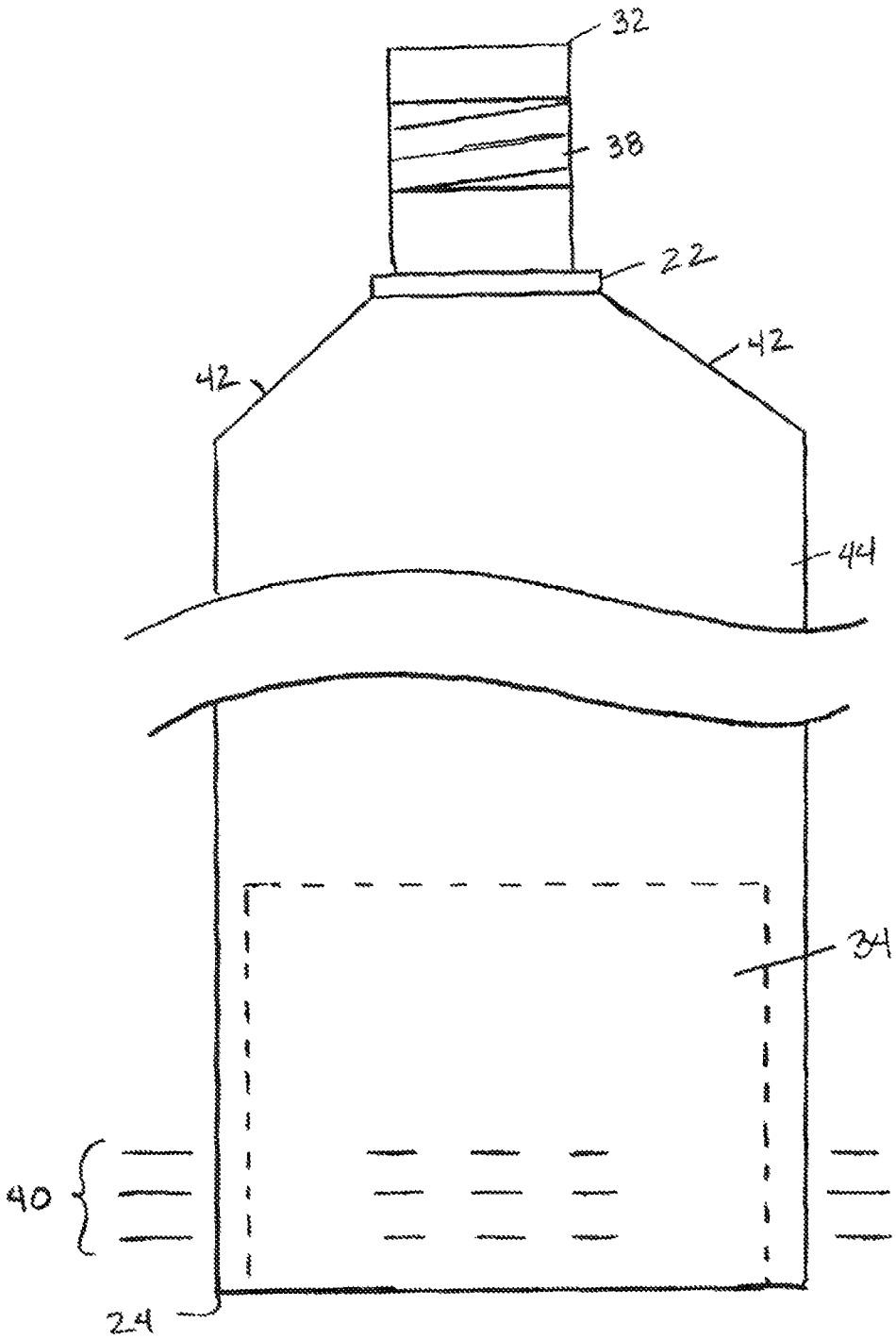
FIG. 3 is a front view of a paddle portion of the goalie hockey stick illustrated in FIG. 1.
Figure 4:
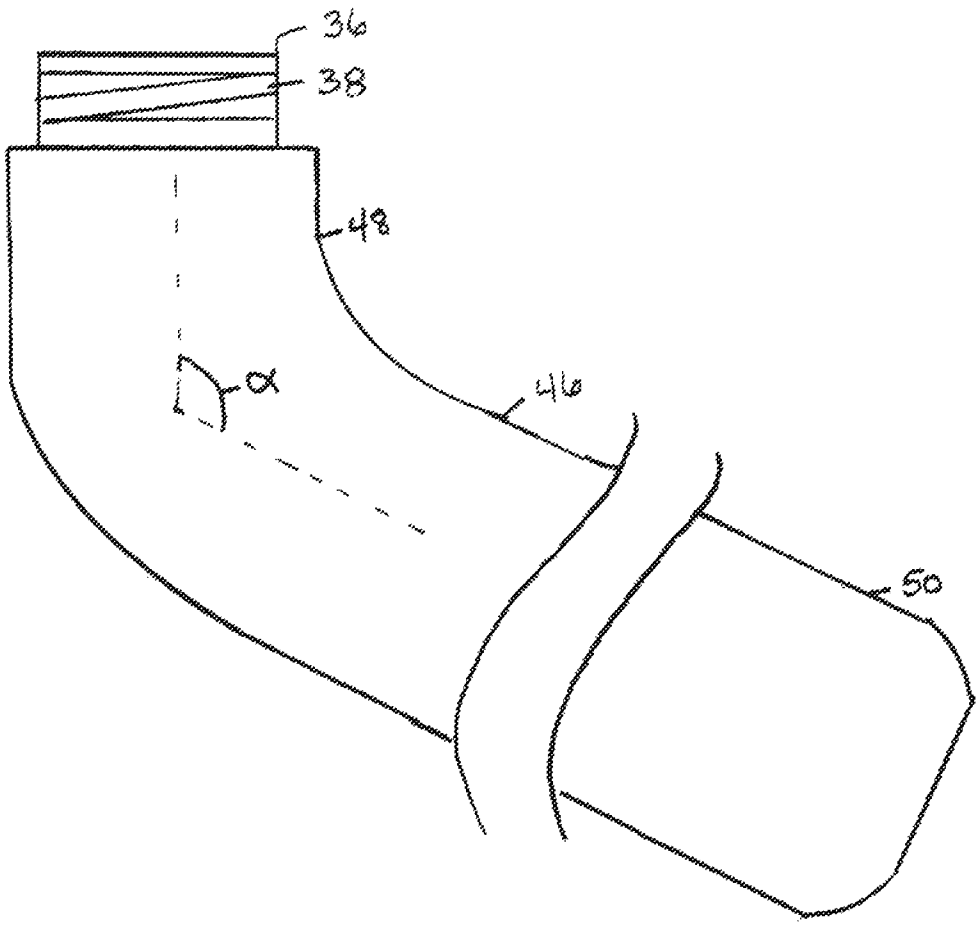
FIG. 4 is a front view of a blade portion of the goalie stick illustrated in FIG. 1.

For example, the handle 12, paddle 14, and blade 16 may be connected to one another using an epoxy, hot melt glue, or similar adhesive fastener. Alternatively, the handle 12, paddle 14, and blade 16 may be connected to one another via a suitable threaded fastener, such as a screw. In still another embodiment, which is illustrated in FIGS. 3 and 4, a tape 38, such as athletic tape, may be wrapped around the male ends 32, 36, to ensure a strong connection. Regardless of the fastener employed, it is contemplated that the fastener will permit disassembly of the goalie hockey stick 10 so that one or more of the handle 12, the paddle 14, or the blade 16 may be replaced during the lifetime of the goalie hockey stick 10.

In the case where adhesives are employed, it is contemplated that the adhesive will permit a removable attachment between the handle 12, the paddle 14, and the blade 16. Adhesives that remain tacky for extended periods of time are contemplated for use with the present invention. In addition, hot melt adhesives may be employed, as they melt upon the application of heat and, therefore, permit disassembly after heating. As should be apparent to those skilled in the art there are a wide variety of adhesives that may be employed without departing from the scope of the present invention.

In the case where a tape 38 is employed to hold the handle 12, the paddle 14, and the blade 16 together in a press-fitted manner, there are a number of suitable tapes 38 that may be employed. In one contemplated embodiment, a player may use athletic tape 38. Athletic tape 38 is a woven tape made from cotton (among other materials) that has been impregnated with a tacky material. In still another contemplated embodiment, a player might employ tape 38 made from polytetrafluoroethylene. Still further examples of tapes 38 may be employed without departing from the scope of the present invention.

Figure 2:
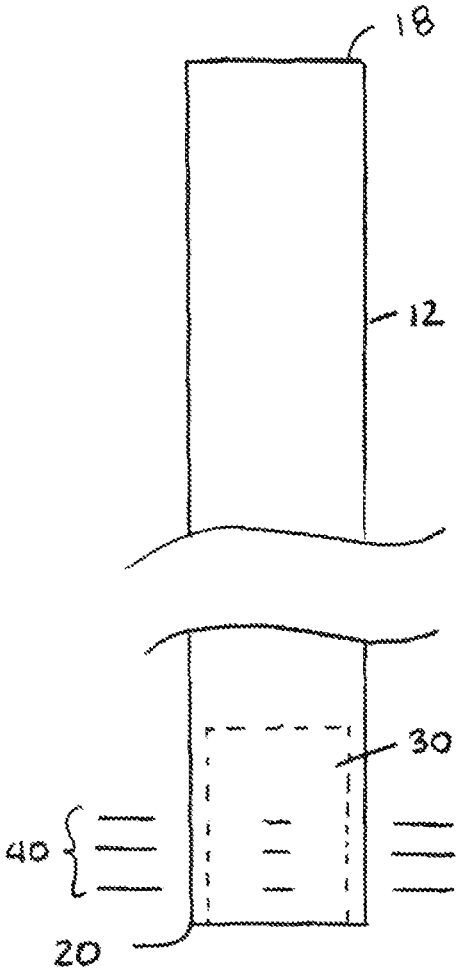
FIG. 2 is a front view of a handle portion of the goalie hockey stick illustrated in FIG. 1.

With reference to FIG. 2, the handle 12 is shown in an enlarged detail. As noted above, the handle 12 includes a female receiver 30 at its bottom end 20. It is contemplated that the depth of the female receiver 30 will be greater than the length of the male end 32. Similarly, with reference to FIG. 3, it is contemplated that the female receiver 34 will have a depth greater than the length of the male end 36. In both cases, the additional depth of the female receivers 30, 34 permit the goalie hockey stick 10 to be sized for the player.

As indicated in FIGS. 2 and 3, the bottom end 20 of the handle 12 and the bottom end 24 of the paddle 14 may be provided with indicia 40 that permit a user to saw off (or cut off) a portion of the handle 12 or of the paddle 14 to shorten the total length of the goalie hockey stick 10. As such, length of the goalie hockey stick 10 may be sized to accommodate any height of user. It is noted that the indicia 40 are provided merely as an example. Indicia 40 are not required to practice the present invention.

It is noted that hockey sticks in the prior art typically are manufactured in one inch increments. As such, a player seeking to purchase a non-traditional length of a hockey stick is limited in his or her choices. Typically, players will select the size that is most suitable for that player's body type and adapt to the length of the hockey stick. With the present invention, the player is not so limited. Instead, as noted above, the player may modify the length of the goalie hockey stick 10 to meet the players needs and performance requirements rather than settling for an approximate length for the goalie hockey stick.

FIG. 3 illustrates the paddle 14 of the present invention. Near to its top end 22, the paddle 14 defines a shoulder 42, which defines the transition from the male end to the main body 44 of the paddle 14. In this illustrated embodiment, the shoulder 42 is shown as a trapezoid. It is noted that this shape is merely illustrative of the wide variety of different shapes for the shoulder 42. The shoulder may be semi-circular, ellipsoidal, polygonally, or amorphously shaped, among virtually a limitless number of different possibilities.

It is understood that, in addition to player preference, the shoulder 42 may affect the performance of the goalie hockey stick 10. As should be apparent, a more robust shoulder 42 is anticipated to provide greater lateral strength. A less robust shoulder 42, on the other hand, may impart a greater degree of flexion to the paddle 14.

Since the construction of the shoulder 42 has an impact on the performance of the goalie hockey stick 10, it is contemplated that players may desire to replace one paddle 14 with a different paddle 14 to alter the performance of the goalie hockey stick 10. The modular construction of the goalie hockey stick 10 of the present invention permits such a replacement. In contrast, with respect to the prior art, players do not have this flexibility. Instead, as noted above, if the player wished to have a paddle 14 with a different shoulder 42, the player is required to purchase a new hockey stick.

FIG. 4 is a front view of the blade 16 of the goalie hockey stick 10 of the present invention. The blade 16 includes a main body 46 having a vertical section 48 and an angled section 50. The vertical section 48 and the angled section 50 form an angle $\alpha$ with respect to one another. While the angle $\alpha$ may be any angle, it is customary for this angle to be between 10-20°. More specifically, the angle may be between 15-17°. As should be apparent, however, the angle $\alpha$ may be larger or smaller than these rangers without departing from the scope of the present invention.

The angle $\alpha$ presents another feature of the goalie stick 10 of the present invention that a player might wish to alter. For example, if the player owns a blade 16 with a an angle $\alpha$ of 15°, the player might want to change the blade 16 to one where the angle $\alpha$ is 17°. With the modular construction of the goalie hockey stick 10 of the present invention, this change is made possible.

Figure 5:
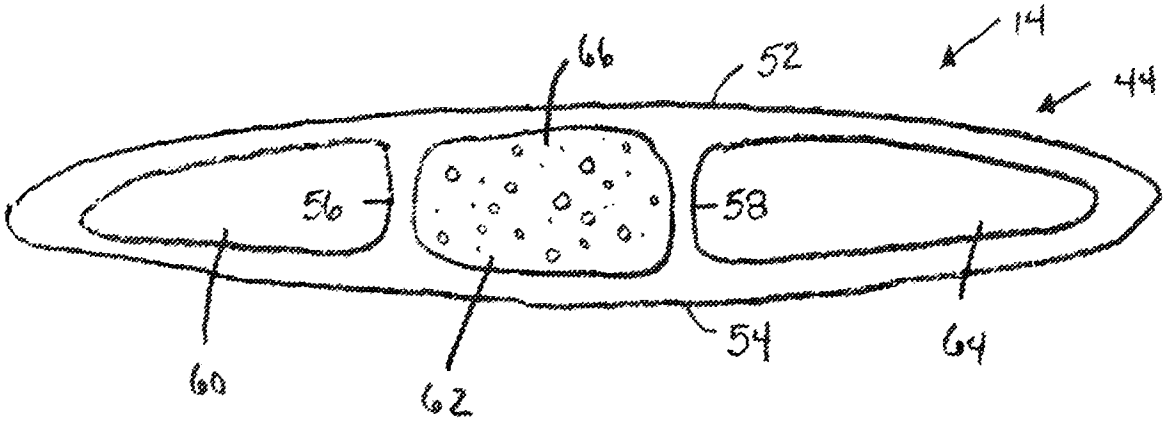
FIG. 5 is cross-sectional view of the paddle portion of the hockey stick illustrated in FIG. 1, the cross-section being taken along line 5-5 in FIG. 1.

FIG. 5 provides a cross-section of one contemplated construction for the body 44 of the paddle 14. As noted above, it is contemplated that the paddle 14 will be made from a carbon fiber composite material. The carbon fiber composite material forms the front surface 52, the rear surface 54 and two bridges 56, 58 that internally connect the front surface 52 to the rear surface 54. So constructed, the paddle 14 includes three interior compartments 60, 62, 64. In the embodiment illustrated, the central compartment 62 is filled with a foam material 66.

Concerning the manufacture of the paddle 14 (as well as the handle 12 and the blade 16), it is noted that carbon fiber construction typically employs a carbon fiber material (whether woven or not) that is layered over one or more inflatable bags within a mold. The bags are then inflated as resin is injected into the mold. Once the resin hardens, the final product is removed from the mold. With respect to the embodiment illustrated in FIG. 5, therefore, the paddle 14 was constructed using three inflatable bags, one for each compartment 60, 62, 64 defined therein.

With continued reference to FIG. 5, the foam 66 is provided within the central compartment 62 to provide damping of vibration associated with use of the goalie hockey stick 10. The foam 66 may be an open cell or a closed cell foam. In the illustrated embodiment, the foam 66 is contemplated to be a twenty-four (24) pound foam, the details of which should be apparent to those skilled in the art.

While the foam 66 is provided in the central compartment 62, in alternative embodiments, the foam 66 may be included in any one or all of the compartments 60, 62, 64 without departing from the scope of the present invention. In still further embodiments, the foam may occupy only a portion of the compartments 60, 62, 64.

As should be apparent to those skilled in the art, the construction of the paddle 14 including three internal compartments 60, 62, 64 is only one contemplated construction for the paddle 14. It is contemplated that a larger or a fewer number of compartments 60, 62, 64 may be employed without departing from the scope of the present invention.

Figure 6:
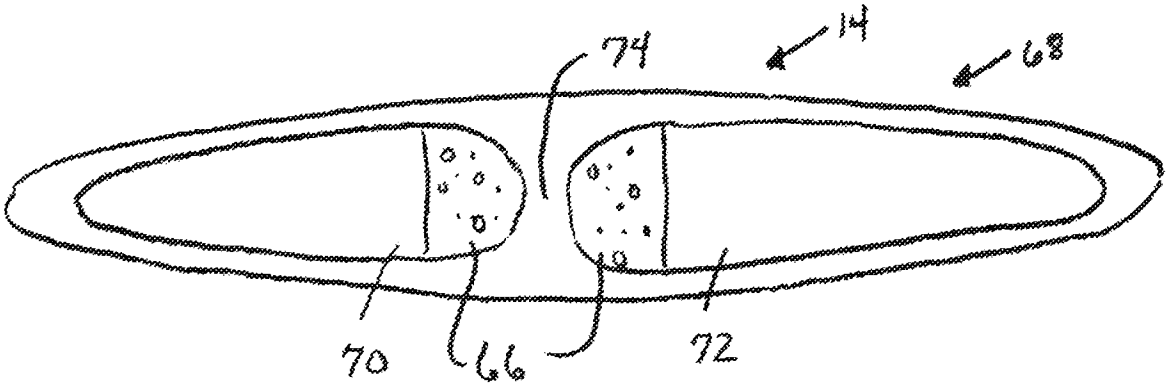
FIG. 6 is a cross-section of a variation of the paddle portion illustrated in FIG. 5.

To this end, reference is now made to FIG. 6, which provides a cross-section of one contemplated embodiment for the present invention. Here, the paddle 14 includes a main body 68 made from a carbon fiber composite material having two internal compartments 70, 72 separated by a single bridge 74. The compartments 70, 72 are filled only partially with the foam 66.

Figure 7:
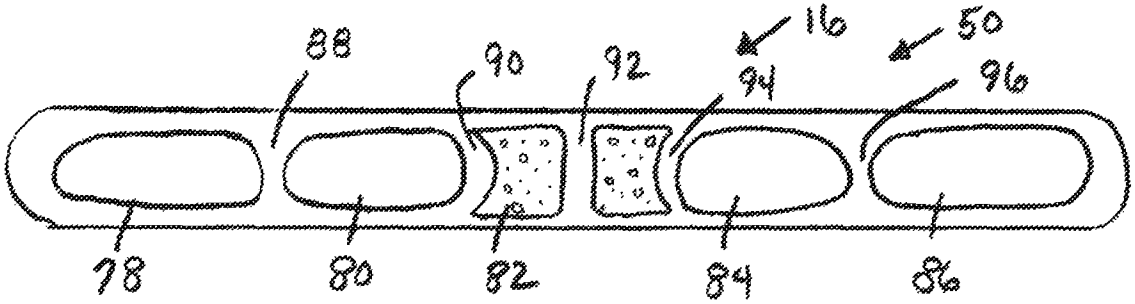
FIG. 7 is a cross-section of blade portion of the hockey stick illustrated in FIG. 1, the cross-section being taken along line 7-7 in FIG. 1.

FIG. 7 is a cross-sectional illustration of the internal construction for the blade 16 of the present invention. As with the paddle 14, the blade 16 is made from a carbon fiber composite, without limitation of the large number of different materials that may be used therefor. As illustrated, the blade 16 includes six compartments 76, 78, 80, 82, 84, 86 separated by bridges 88, 90, 92, 94, 96. The foam 66 is included in the compartments 82, 84, to provide a dampening effect.

As with the paddle 14, the foam 66 may be provided in any one or all of the compartments 76, 78, 80, 82, 84, 86. In addition, the foam 66 may occupy only a portion of one or more of the compartments 78, 80, 82, 84, 86.

Figure 8:
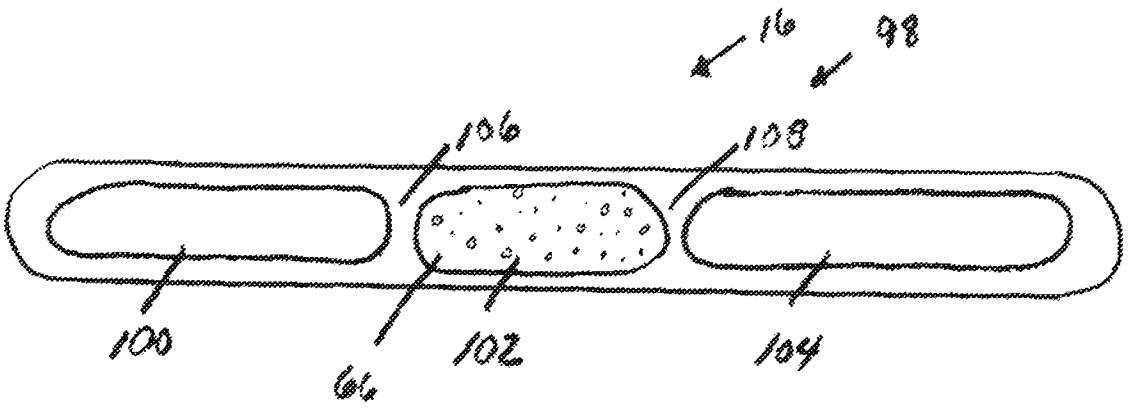
FIG. 8 is a cross-section of a first variation of the blade portion illustrated in FIG. 7.

The blade 16 also may be constructed to have a larger or a smaller number of internal compartments. For example, as illustrated in FIG. 8, the blade 16 includes a main body 98 with three compartments 100, 102, 104 separated by bridges 106, 108. The foam 66 is provided in the center compartment 102 to dampen vibrations.

Figure 9:
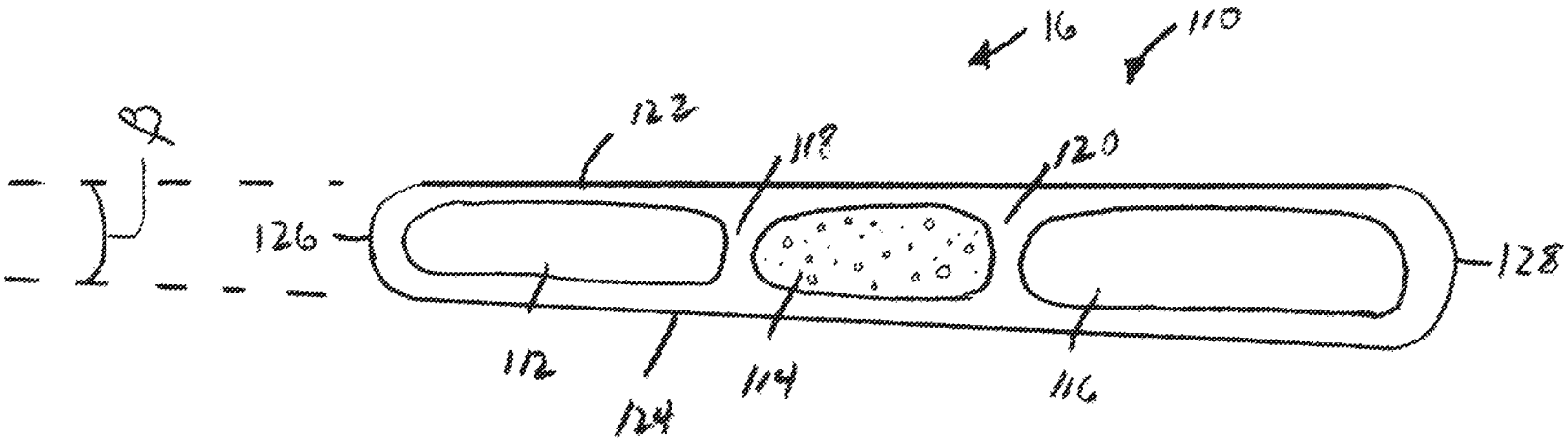
FIG. 9 is a cross-section of a second variation of the blade portion illustrated in FIG. 7.

FIG. 9 is a cross-sectional illustration of yet another embodiment of the blade 16 of the present invention. Here, the blade 16 has a main body 110 with compartments 112, 114, 116 separated by bridges 118, 120. The foam 66 is provided in the central compartment 114.

In this embodiment, the rear face 122, front face 124, top edge 126, and bottom edge 128 are identified. For this embodiment of the blade 16, the front face 124 and the rear face 122 are angled with respect to one another by an angle β. The angle may be any suitable angle. It is contemplated that the angle β will fall within a range of 3-15°. More specifically, the angle β is contemplated to be between 3-7°. Of course, any angle that is greater or smaller than the angles in these ranges may be employed without departing from the scope of the present invention.

Figure 10:
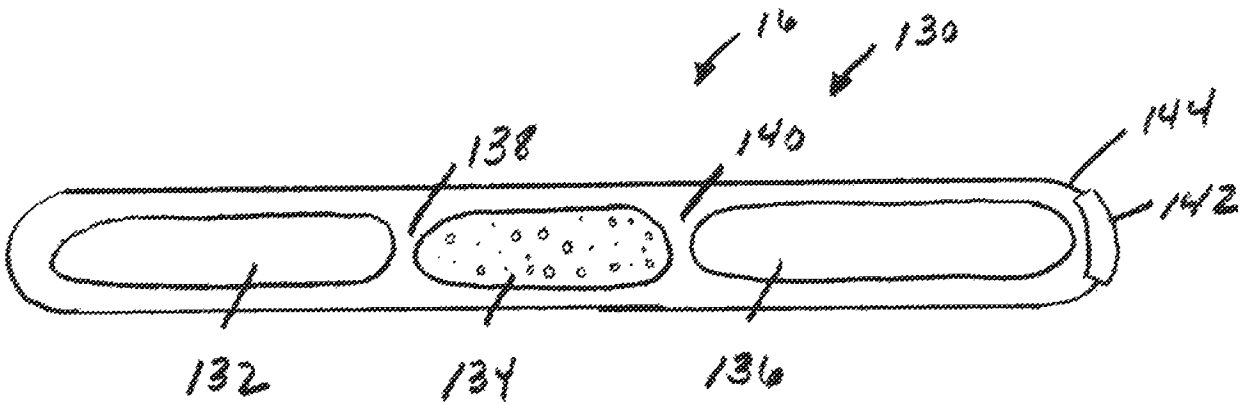
FIG. 10 is a cross-section of a third variation of the blade portion illustrated in FIG. 7.

FIG. 10 is a cross-sectional view of still another embodiment of the blade 16 contemplated for the present invention. Here, the blade 16 includes a main body 130 with compartments 132, 134, 136 separated by bridges 138, 140. The foam 66 is included in the central compartment 134, as in prior embodiments.

In this embodiment, the main body 130 includes a wear-resistant portion 142 at the bottom edge 144 of the blade 16. The wear-resistant portion 142 is the part of the blade 16 that comes into contact with the ice or other surface on which hockey is played (i.e., a field or paved surface). The wear-resistant portion 142 may be a removable insert or permanently incorporated into the blade. In one contemplated embodiment, the wear-resistant portion 142 may be a grouping of carbon fibers that are braided together so that, after resin injection during manufacture, the braided fibers present a harder bottom surface for the blade 16.

As should be apparent from the foregoing, the material(s) selected for the goalie hockey stick 10 of the present invention are anticipated to provide suitable stiffness, durability, abrasion resistance, and wear resistance, among other suitable properties that should be apparent to those skilled in the art.

With respect to the foam 66, it is noted that the foam may be injected into the compartments within the handle 12, the paddle 14, or the blade 16 in a two part format (or multipart format). As should be apparent to those skilled in the art, the foam 66 may result from a chemical reaction between two or more reactants, which are injected into the predetermined compartment. Alternatively, the foam may be manufactured as a pre-made item that is inserted into the selected compartment.

Finally, it is noted that multiple types of foams may be employed in any one embodiment of the present invention. It is contemplated that a combination of different foams may offer advantages with respect to the performance of the goalie hockey stick. As a result, the present invention should not be understood to be limited to any one particular type of foam.

As noted above, the present invention encompasses a broad scope. Any discussion of specific details in connection with embodiments is not intended to be limiting of the invention. To the contrary, the specific embodiments described above are intended to illustrate the breadth of the present invention.

What is claimed is:

1. A goalie hockey stick, comprising:

a handle with a handle top end and a handle bottom end defining a handle length, the handle bottom end having a first female receiver therein, the first female receiver having a first depth;

a paddle with a paddle top end and a paddle bottom end defining a paddle length, the paddle top end having a first male end disposed thereon, the first male end having a first length, the bottom end having a second female receiver therein, the second female receiver having a second depth, the first male end being inserted into the first female receiver; and a blade with a blade top end and a blade bottom end, the blade top end having a second male end disposed thereon, the second male end having a second length, the second male end being inserted into the second female receiver, wherein the handle, the paddle, and the blade are removably connected to one another, the first depth is greater than the first length, permitting the handle length to be shortened by removing a portion of the handle at the handle bottom end while continuing to allow the first male end without shortening to be received therein, the second depth is greater than the second length, permitting the paddle length to be shortened by removing a portion of the paddle at the paddle bottom end while continuing to allow the second male end without shortening to be received therein, the blade includes at least two internal compartments extending longitudinally therein, the blade further comprises at least one bridge, connecting front and rear surfaces of the paddle to one another, the bridge separating the internal compartments from one another, and a foam is disposed at least partially within one of the internal compartments.

2. The goalie hockey stick of claim 1, wherein the handle, the paddle, and the blade are removably connected to one another via a press-fit connection between the first male end and the first female receiver and between the second male end and the second female receiver.

3. The goalie hockey stick of claim 1, further comprising:

a first fastener, provided with respect to the first male end and the first female receiver, to provide additional force to connect the handle and the paddle to one another; and a second fastener, provided with respect to the second male end and second first female receiver, to provide additional force to connect the paddle and the blade to one another.

4. The goalie hockey stick of claim 3, wherein at least one of the first and second fasteners is a threaded fastener.

5. The goalie stick of claim 3, wherein at least one of the first and second fasteners is an adhesive.

6. The goalie hockey stick of claim 5, wherein the adhesive is a hot melt adhesive.

7. The goalie hockey stick of claim 3, wherein at least one of the first and second fasteners is a tape.

8. The goalie hockey stick of claim 7, wherein the tape is an athletic tape comprising cotton.

9. The goalie hockey stick of claim 1, wherein the handle, the paddle, and the blade comprise a carbon fiber composite material.

10. The goalie hockey stick of claim 9, wherein the carbon fiber composite material comprises at least one of woven or non-woven carbon fibers.

11. The goalie hockey stick of claim 10, wherein the paddle further comprises:

at least three internal compartments extending longitudinally therein; and at least two bridges, connecting front and rear surfaces of the paddle to one another, the bridges separating the internal compartments from one another.

12. The goalie hockey stick of claim 11, further comprising:

a foam disposed within at least one of the at least three compartments within the paddle.

13. The goalie hockey stick of claim 12, wherein the foam is at least one of an open cell or closed cell foam.

14. The goalie hockey stick of claim 1, wherein the blade further comprises at least three internal compartments extending longitudinally therein; and at least two bridges, connecting front and rear surfaces of the paddle to one another, the bridges separating the internal compartments from one another.

15. The goalie hockey stick of claim 14, further comprising:

a foam disposed within at least one of the at least three compartments within the blade.

16. The goalie hockey stick of claim 15, wherein the foam is at least one of an open cell or closed cell foam.

17. The goalie hockey stick of claim 15, wherein:

the at least three internal compartments comprise six internal compartments and the foam is disposed within at least two of the compartments.

18. The goalie hockey stick of claim 1, further comprising:

a wear-resistant portion disposed along at least a portion of a bottom edge of the blade.

19. The goalie hockey stick of claim 18, wherein:

the wear-resistant portion is formed as a braid of carbon fibers.

20. The goalie hockey stick of claim 1, further comprising:

indicia at the handle bottom end and the paddle bottom end indicating size information for the handle and the paddle.

* * * * *